United States Patent [19]

Inagaki

[11] 4,011,988

[45] Mar. 15, 1977

[54] DEVICE FOR CONTROLLING THE FLOW OF COOLING WATER IN AN INTERNAL COMBUSTION ENGINE

[75] Inventor: Masao Inagaki, Okazaki, Japan

[73] Assignee: Toyota Jidosha Kogyo Kabushiki Kaisha, Toyota, Japan

[22] Filed: July 16, 1975

[21] Appl. No.: 596,408

[30] Foreign Application Priority Data

July 22, 1974 Japan ..... 49-83293

[52] U.S. Cl. ..... 236/34.5; 123/41.02; 123/41.08; 165/40; 236/93 A

[51] Int. Cl.[2] ..... F01P 7/02

[58] Field of Search ..... 236/34, 34.5, 93 R, 236/93 A; 123/41.02, 41.08; 165/40

[56] References Cited

UNITED STATES PATENTS

| | | | |
|---|---|---|---|
| 1,784,063 | 12/1930 | Giesler | 123/41.02 X |
| 1,785,207 | 12/1930 | Page | 123/41.08 |
| 2,954,930 | 10/1960 | Linder | 236/34.5 |
| 2,988,280 | 6/1961 | Kimm et al. | 236/34.5 |
| 3,921,600 | 11/1975 | Henning et al. | 236/34.5 X |

*Primary Examiner*—William E. Wayner
*Assistant Examiner*—William E. Tapolcai, Jr.
*Attorney, Agent, or Firm*—Stevens, Davis, Miller & Mosher

[57] ABSTRACT

A device for controlling the flow of cooling water circulating between the radiator and the water jacket in an internal combustion engine. A thermal reactive valve means is disposed in a passage interconnecting the radiator and the water jacket for providing a first and a second opening for permitting the cooling water to flow therethrough, said first and second openings being opened at a predetermined first and second temperature of the cooling water, respectively.

5 Claims, 6 Drawing Figures

DEVICE FOR CONTROLLING THE FLOW OF COOLING WATER IN AN INTERNAL COMBUSTION ENGINE

DESCRIPTION OF THE INVENTION

The present invention relates to a device for controlling the flow of cooling water circulating between the radiator and the water jacket in an internal combustion engine.

A conventional internal combustion engine, particularly one used for an automobile, is provided with a thermostat which is arranged at the upper portion of the cylinder head and in the cooling water passage connected to the radiator. This arrangement can be more easily understood by referring to FIG. 1 which schematically shows a conventional engine. Heat generated in each cylinder 10 is transferred to the cooling water in the water jacket enclosing each cylinder wall. Since sections of said water jacket are connected to each other in the cylinder head 11, the cooling water in the water jacket is collected into the cylinder head 11 and, then, the cooling water supplied to the radiator 13 via the cooling water passage 12 is cooled therein. Then, the cooling water in the radiator 13 passes through the water pump 15 via the passage 14 and is again returned into the water jacket. In such a forced circulation cooling system, in which the circulation is effected by the water pump 15, the thermostat 16 is arranged at the upper portion of the cylinder head 11 and in the cooling water passage 12 so as to maintain the temperature of the cooling water at an optimum temperature.

A wax type thermal reactive valve is generally used as the thermostat 16. The thermostat 16 is operated in such a manner that, when a temperature of the cooling water contained in the cylinder head 11 reaches a predetermined temperature, the thermal reactive valve is opened. That is, the thermal reactive valve is provided for interrupting the flow of the cooling water supplied to the radiator while a temperature of the cooling water is lower than a predetermined value after the starting of the engine. When the thermal reactive valve 16 is closed, the temperature of the cooling water contained in the water jacket can be increased instantly, since only a small amount of the cooling water is passed through the bypass 17 and is instantly returned into the water jacket.

A conventional thermal reactive valve 16 is provided with an air vent communicating the cooling water passage 12 with the interior of the cylinder head 11 in order to vent the air which is mixed into the cooling water when new cooling water is supplied into the cylinder head. However, if the thermal reactive valve is provided with an air vent, in course of the warming up of an engine, the cooling water flows through the air vent and circulates between the radiator and the water jacket. This results in the required temperature of the cooling water not being obtained, particularly under a cold conditions.

In order to avoid this disadvantage, a thermal reactive valve provided with a pendulum valve has been proposed. This pendulum valve functions as an air vent when new cooling water is supplied into the cylinder head and is closed by the pressure of the cooling water in the cylinder head after the starting of the engine. By providing the pendulum valve, the warming up performance of an engine is increased, since the cooling water in the cylinder head is prevented from flowing into the radiator in course of the warming up of the engine. However, the provision of the pendulum valve causes a new problem because the temperature of the cooling water increases beyond the optimum temperature. This problem can be more clearly understood by referring to FIG. 2. In FIG. 2, the ordinate indicates the temperature T of the cooling water and the abscissa indicates the time *t*. Assuming that a required temperature of the cooling water is T′, the thermal reactive valveis set so as to open at temperature T′. Referring to FIG. 1, when an engine is started and the temperature of the cooling water is relatively low, a small amount of the cooling water in the cylinder head is circulated by the water pump 15 through the bypass 17. At this time, since the cooling water in the cylinder head is prevented from flowing into the radiator by the action of the pendulum valve, the cooling water has a tendency to stagnate near to the thermal reactive valve 16 and the response rate of the thermal reactive valve 16 is delayed compared with the speed of the increase in temperature of the cooling water, therefore, the thermal reactive valve 16 can not be opened until the temperature of the cooling water in the water jacket increases considerably. Thus, when the thermal reactive valve 16 is opened, as is shown in FIG. 2, the temperature of the cooling water at the cooling water outlet from the engine (indicated by A) is considerably over the required temperature T′ of the cooling water. As a result, cooling water having a relatively high temperature rapidly flows into the cooling water passage 12. At the same time the cooling water in the radiator, having a relatively low temperature, rapidly enters the water jacket. Consequently, the temperature of the cooling water at the cooling water inlet into the engine (indicated in B) must be decreased considerably. Thus the cylinder and the cylinder head are instantaneously varied in temperature, causing the thermal stress therein to be increased. The repetition of this variation in temperature results in cracks in the cylinder or a passing of the combustion gas through the gasket.

In order to eliminate these disadvantages, a new cooling method recently was adopted. In this new method a thermal reactive valve is arranged in the cooling water inlet into the engine. While it is true that the new cooling method definitely prevents the cooling water from increasing beyond the optimum temperature T′, it has the following disadvantages.

i. An engine requires a long time to become warmed up.

ii. Since the bypass of the cooling water must be arranged beneath the water pump, the piping of the bypass becomes complicated and, thus, the cost of manufacturing an engine increases.

iii. It is difficult to repair the thermal reactive valve.

iv. It is necessary to manufacture an engine housing with a new construction in order to fit such thermal reactive valve into the engine housing.

An object of the present invention is to eliminate the above mentioned disadvantages.

According to the present invention, a device for controlling the flow of cooling water circulating between the radiator and the water jacket in an internal combustion engine, comprises:

passage means for interconnecting the radiator and the water jacket, and;

thermal reactive valve means, disposed in said passage means, for providing a first opening and a second opening for permitting the cooling water to flow therethrough, said first opening being opened at a predetermined first temperature of the cooling water and said second opening being opened at a predetermined second temperature of the cooling water which is lower than said first temperature.

The above mentioned object of the invention will be more fully understood from the following description of a preferred embodiment of the invention, together with the accompanying drawings.

DESCRIPTION OF A PREFERRED EMBODIMENT

Figure 1:
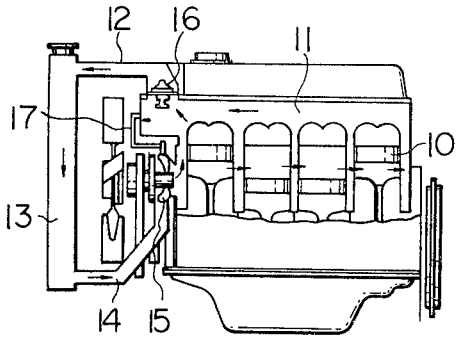
FIG. 1 is a schematically illustrated side elevational view, partly in cross section, of an internal combustion engine.
Figure 3:
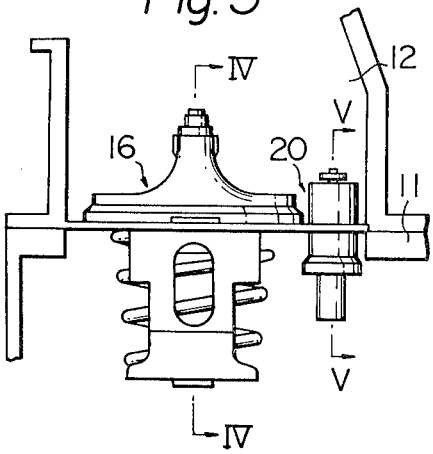
FIG. 3 is a side elevational view of the thermal reactive valve and the thermal reactive auxiliary valve according to the present invention.
Figure 4:
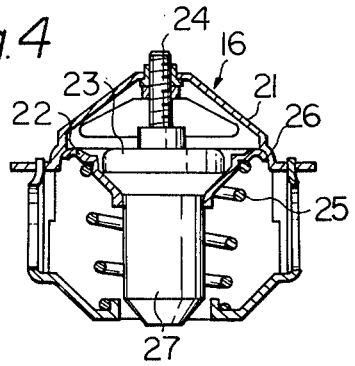
FIG. 4 is a side view of the thermal reactive valve, partly in cross section, taken along the line IV—IV in FIG. 3.

Referring to FIG. 3, adjacent to the conventional wax type thermal reactive valve 16 (FIG. 1) a wax type thermal reactive auxiliary valve 20 according to the present invention is disposed at the upper portion of the cylinder head 11 and in the cooling water passage 12 connected to a radiator 13. Referring to FIG. 4 which shows a cross-section of the conventional thermal reactive valve 16, a wax sensor body 23, to which a valve 22 is secured, is arranged in the housing 21. A rod 24, which is able to relatively slide with respect to the wax sensor body 23, is projected from the wax sensor body 23 which has a temperature detecting portion 27 filled with a wax therein. The rod 24 projects further when the temperature detecting portion 27 detects a predetermined temperature. Since the rod 24 is fixed at its upper end to the housing 21, when the temperature detecting portion 27 detects the predetermined temperature, the wax sensor body 23, together with the valve 22, moves downwardly against the spring force of a spring 25. At this time, the valve 22 leaves a valve seat 26 of the housing 21, causing the thermal reactive valve 16 to be opened.

Figure 5:
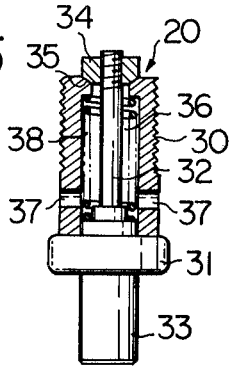
FIG. 5 is a side view of the thermal reactive auxiliary valve, partly in cross section, taken along the line V—V in FIG. 3.

Referring to FIG. 5, which shows the wax type thermal reactive valve 20 according to the present invention, a wax sensor body 31 is fixed to the bottom surface of a housing 30. In a similar manner to the thermal reactive valve 16, the wax sensor body 31 has a rod 32 projecting therefrom on the one side, and a temperature detecting portion 33 on the other side. A valve 34 is fixed to the upper end of the rod 32. When the temperature of the cooling water surrounding the wax sensor portion 31 is relatively low, the valve 34 continues to abut against a valve seat 35 formed on the upper surface of the housing 30, whereby the thermal reactive valve 20 is closed. A hollow passage 36 is formed in the housing 20 and is in communication with the outside of the housing 30 through a port 37 formed in the side wall of the housing 30. A spring 38 is disposed in the hollow passage 36 of the housing 30 and the rod 32 is always urged downward by the spring force of the spring 38. When the temperature detecting portion 33 detects a predetermined temperature, the rod 32 moves upward and the valve 34 leaves the valve seat 35, thus causing the thermal reactive valve 20 to be opened. At this time, fluid can flow from the port 37 through the hollow passage 36 and the gap between the valve 34 and the valve seat 35.

The thermal reactive auxiliary valve 20 has a narrower flow area which is formed between the valve 34 and the valve seat 35 when the valve 20 is opened, compared with a flow area of the thermal reactive valve 16 when it is opened. Therefore, if the pressure of fluid in front of the valve 22, 34 is equal to that of fluid behind the valve 22, 34, the thermal reactive auxiliary valve 20 allows a smaller amount of fluid to pass compared with the thermal reactive valve 16. Further, the temperature at which the thermal reactive auxiliary valve 20 is opened, that is the detected temperature of the temperature detecting portion 33, is predetermined so as to be slightly lower than the temperature at which the thermal reactive valve 16 is opened.

As is shown in FIG. 3, each temperature detecting portion 27, 33 of these two thermal reactive valves 16, 20 is submerged in the cooling water in the cylinder head 11.

Figure 2:
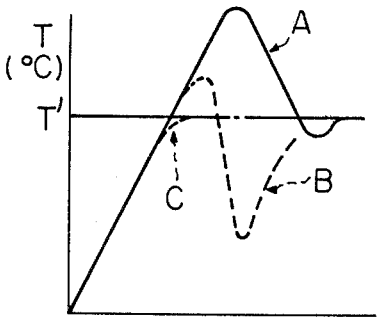
FIG. 2 is a graph showing change in temperature of the cooling water.

Both thermal reactive valves 16 and 20 are closed during the time the temperature of the cooling water is relatively low after the starting of the engine. Then, the temperature of the cooling water gradually increases and the thermal reactive auxiliary valve 20 is opened before the temperature of the cooling water in the cylinder head 11 reaches an optimum temperature T', causing a small amount of the cooling water to enter the radiator 13. The cooling water fed to the radiator 13 is cooled therein and circulated again into the water jacket and, consequently, the temperature of the cooling water in the water jacket is slowly increased. When the temperature of the cooling water in the cylinder head further gradually increases slightly beyond the optimum temperature T' of the cooling water, the thermal reactive valve 16 is opened. As a result, the majority of the cooling water flows into the radiator 13 through the thermal reactive valve 16 and is again circulated into the water jacket. At this time, since the thermal reactive auxiliary valve 20 has been opened and the temperature of the cooling water in the radiator 13 has already been increased, the temperature of the cooling water at the cooling water outlet from the engine and at the cooling water inlet into the engine are not rapidly varied. As a result, as is shown by curve C in FIG. 2, the temperature of the cooling water is slowly increased. Thus the thermostat provided with the thermal reactive auxiliary valve 20 according to the present invention prevents the cooling water from increasing beyond the optimum temperature T' (see curve A in FIG. 2), which can occur with a conventional thermostat.

It is preferable that the thermal reactive auxiliary valve 20 be disposed adjacent to the thermal reactive valve 16, so that the cooling water does not stagnate around the temperature detecting portion 27 of the thermal reactive valve 16, since the cooling water must flow around the temperature detecting portion 27 after the thermal reactive auxiliary valve 20 is opened. Further, one of the thermal reactive valves 16 or 20 must include an air vent having the aforementioned pendulum valve or something similar to the air vent which has the same functions as said air vent (not shown).

The present invention has been described hereinbefore with reference to the preferred embodiment, however, there are many other modifications. In one modification, another cooling water passage interconnecting the radiator 13 and the water jacket in the cylinder head 11 (not shown), in addition to the cooling water passage 12, can be provided for mounting the thermal reactive auxiliary valve 20 therein. In this case, the thermal reactive auxiliary valve 20 is preferably disposed in the other cooling water passage at the cooling water outlet from the water jacket.

Figure 6:
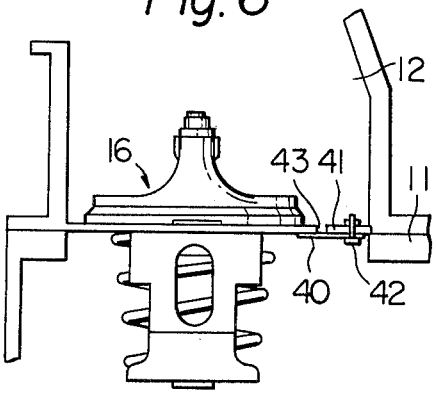
FIG. 6 is a side elevational view of the thermal reactive valve and the reed type valve functioning as a thermal reactive auxiliary valve.

In another modification, as shown in FIG. 6, the thermal reactive auxiliary valve is formed as a reed type valve comprising a reed 40 made of a bimetallic material and fixed to the valve mounting plate 41 by means of a bolt 42, and a through-hole 43 formed on the valve mounting plate 41. The reed type valve is opened before the temperature of the cooling water in the cylinder head 11 reaches an optimum temperature T'. Of course, the reed type valve can be fitted in the other cooling passage described in the preceding modification.

From the above, it will be understood that the following various effects are advantageously provided by the present invention.

i. Cracks in the cylinder and cylinder head caused by thermal stress are prevented, since the present invention is able to prevent the cooling water from increasing beyond the optimum temperature.

ii. By the provision of the thermal reactive auxiliary valve, an optimum temperature of the cooling water can be stably obtained without affecting the warming up of the engine.

iii. An engine provided with the thermostat of the present invention is easily manufactured with no substantial change in the construction of a conventional engine.

iv. Even if the thermal reactive valve malfunctions, the thermal reactive auxiliary valve is still operated and, therefore, the thermal reactive auxiliary valve serves to prevent heat seizure of the pistons caused by overheating of the engine.

v. In a conventional engine, when the temperature of the cooling water increases beyond the optimum temperature, the heat gauge, which is mounted on the gauge panel in a driver's compartment, indicates an extraordinary increase in the temperature of the cooling water. This indication of the heat gauge results in driver confusion. Contrary to this, in the present invention, said confusion can be avoided by the provision of the thermal reactive valve.

vi. The opening of the thermal reactive auxiliary valve is not delayed, because the auxiliary valve according to the present invention has a temperature detecting portion of relatively small size.

What is claimed is:

1. A device for controlling the flow of coolant circulating between the radiator and the water jacket in an internal combustion engine, comprising:

single coolant passage means interconnecting the radiator and the water jacket, and;

thermal reactive valve means, disposed in said passage means, for providing a first opening and a second opening for permitting the coolant to flow therethrough, said first opening having a first thermal reactive valve to open for passage of coolant at a predetermined first temperature of the coolant and said second opening having a second thermal reactive valve to open for passage of coolant at a predetermined second temperature of the coolant, said second valve opening at a lower coolant temperature than the first valve and the area of the first opening being larger than that of the second opening.

2. A device as recited in claim 1, wherein each of said first and second thermal reactive valves comprises a wax sensor and a valve member actuated by said wax sensor, said wax sensor being surrounded by the coolant in the water jacket.

3. A device as recited in claim 1, wherein said first thermal reactive valve comprises a wax sensor and a valve member actuated by said wax sensor, and said second thermal reactive valve is a reed type valve.

4. A device as recited in claim 1, wherein said first thermal reactive valve is disposed in said coolant passage adjacent to said second thermal reactive valve.

5. A device as recited in claim 1, wherein said thermal reactive valve means is disposed in said coolant passage at the coolant outlet from the water jacket.

* * * * *